US006595385B2

(12) United States Patent
Nakamoto et al.

(10) Patent No.: US 6,595,385 B2
(45) Date of Patent: Jul. 22, 2003

(54) TOKEN DISPENSING GAME APPARATUS FOR YOUNG CHILDREN

(75) Inventors: Glen Nakamoto, Covina, CA (US); Jeffery Champ, Irvine, CA (US)

(73) Assignee: Mattel, Inc., El Segundo, CA (US)

( * ) Notice: Subject to any disclaimer, the term of this patent is extended or adjusted under 35 U.S.C. 154(b) by 108 days.

(21) Appl. No.: 09/780,791

(22) Filed: Feb. 9, 2001

(65) Prior Publication Data

US 2002/0108961 A1 Aug. 15, 2002

(51) Int. Cl.[7] ..... A24F 11/00; G07F 11/66; G07F 11/16; B65G 59/00; B65H 3/00

(52) U.S. Cl. ..... 221/24; 221/263; 221/265; 221/266; 446/9; 446/83

(58) Field of Search ..... 221/24, 263, 265, 221/266; 446/9, 483

(56) References Cited

U.S. PATENT DOCUMENTS

| | | | | | |
|---|---|---|---|---|---|
| 479,820 | A | * | 8/1892 | Little | 221/24 |
| 936,057 | A | | 10/1909 | Taylor | |
| 1,225,143 | A | * | 5/1917 | Kulick | 221/265 |
| 1,655,296 | A | | 1/1928 | Tapio | |
| 1,804,580 | A | * | 5/1931 | Whitesides | 221/24 |
| 1,859,635 | A | * | 5/1932 | Rose | 221/24 |
| 2,003,979 | A | | 6/1935 | Skoric | |
| 2,256,340 | A | * | 5/1941 | Gora et al. | 221/24 |
| 2,487,380 | A | * | 11/1949 | Rogers | 221/24 |
| 2,514,450 | A | * | 7/1950 | Kopf | 46/98 |
| 2,721,083 | A | | 10/1955 | Allain | |
| 2,731,268 | A | | 1/1956 | Raizen | |
| 2,759,632 | A | * | 8/1956 | Ussery | 221/199 |
| 2,792,227 | A | | 6/1957 | Auerbach | |
| 2,855,124 | A | * | 10/1958 | Gensmer | 221/24 |
| 2,893,735 | A | | 7/1959 | Tranter, Jr. | |
| 3,048,402 | A | | 8/1962 | Schaper | |

(List continued on next page.)

OTHER PUBLICATIONS

Fisher Price Tumblin' Gumballs Dispenser, 2000.*

*Primary Examiner*—Donald P. Walsh
*Assistant Examiner*—Michael E. Butler
(74) *Attorney, Agent, or Firm*—Roy A. Ekstrand

(57) ABSTRACT

A game apparatus includes a figure having a head supporting a rotating plate and a torso supported upon a base. The torso defines a token dispensing passage in communication with the head and further supports a pivotably moveable arm. The arm is pivotable between a raised position and a lowered position against a return spring which urges it toward its raised position. A gear mechanism is operable in response to downward movement of the arm against the return spring to rotate the plate within the figures head and agitate a plurality of disc-like tokens received within the head chamber. A single token is discharged through the torso and outwardly through the door formed in the figures torso to complete token dispensing. The arm is released and the cycle repeated by each player to dispense game tokens.

5 Claims, 4 Drawing Sheets

U.S. PATENT DOCUMENTS 3,120,079 A * 2/1964 Glass et al. ..... 46/98
3,437,338 A 4/1969 Glass et al.
3,565,441 A * 2/1971 Matsumoto ..... 273/143
3,810,535 A * 5/1974 Phipps ..... 194/85
3,845,958 A * 11/1974 Reinertsen ..... 273/135 D
4,120,053 A * 10/1978 Nemirofsky ..... 2/115
4,308,880 A * 1/1982 Graves ..... 132/92
4,324,059 A * 4/1982 Baum ..... 40/416
4,504,058 A * 3/1985 Itoh ..... 273/143
4,635,660 A * 1/1987 Graves ..... 132/92
5,054,782 A * 10/1991 Sutter ..... 273/273
5,071,387 A * 12/1991 Pottick ..... 446/475
5,118,114 A 6/1992 Tucci
5,135,434 A * 8/1992 Mallon ..... 453/43
5,318,469 A * 6/1994 Unalp et al. ..... 446/73
5,356,035 A * 10/1994 Shlopak et al. ..... 222/78
5,480,150 A 1/1996 Weyand
5,634,639 A 6/1997 Tokito et al.
5,662,325 A 9/1997 Weyand
5,664,698 A * 9/1997 Nottingham et al. ..... 222/2
5,673,813 A * 10/1997 Russell ..... 221/203
5,700,178 A * 12/1997 Cimerman et al. ..... 446/301
5,782,378 A * 7/1998 Hart et al. ..... 221/24
D404,431 S * 1/1999 Hoffman et al. ..... D20/7
5,902,169 A * 5/1999 Yamakawa ..... 446/338
5,909,795 A * 6/1999 Porco et al. ..... 194/243
6,267,639 B1 * 7/2001 Menow et al. ..... 446/81

* cited by examiner

TOKEN DISPENSING GAME APPARATUS FOR YOUNG CHILDREN

FIELD OF THE INVENTION

This invention relates generally to token dispensing game apparatus and particularly to such apparatus designed to meet the specific needs of very young children.

BACKGROUND OF THE INVENTION

The challenge of creating and producing games which are appropriate for play by young children such as young children between the ages of three and four years old represents a substantial endeavor. Games for such very young children must be easy to manipulate given the limited dexterity and manual control of such young children. Further, such games must be easy to understand and must develop play patters which can be readily comprehended by young children. Furthermore, games intended for very young children must, of necessity, be extremely to learn and simple in their game results. In addition to these requirements, such games must, of necessity be amusing and interesting to engage the interest of young children. Generally this requirement of interest and amusement is met by providing games which are highly centered on attention grabbing action features.

In addition, practitioner's in the art are often endeavoring to provide games for young children which enhance skill development and learning. For the most part, such skill enhancement must be limited to relatively basic skills such as hand/eye coordination, color discrimination, shape and geometric relationships, numbers or quantities as well as the concept of sequence or sequential actions. It is well recognized among practitioner's of the toy arts that a particular game or toy may succeed or fail based upon its attraction to the child user. However, commercial success often results from skill development qualities in a toy or game appreciated by the parents of such children.

Faced with such challenges and somewhat conflicting requirements and motivated by desires for producing successful games, practitioner's in the toy and game art have provided a virtually endless variety of games directed toward very young children. For example, U.S. Pat. No. 5,480,150 issued to Weyand sets forth a SYSTEM FOR GENERATING RANDOM OUTCOMES USING DISC'S in which a plurality of discs bearing markings or other indicators differentiate them one from another are used to randomly select a number of possible outcomes. The discs may be used to introduce an element of chance in games. Each disc has two sides, one of which is marked with a number. The discs are grouped into sets and the number marked on each disc in a set is the same within the set but is different from all other discs. To use the discs to randomly select an outcome, a persons stacks all of the discs on top of one another and upsets the stack.

U.S. Pat. No. 5,662,325 issued to Weyand sets forth a SYSTEM FOR GENERATING RANDOM OUTCOMES USING DISCS which is a continuation in part of U.S. Pat. No. 5,480,150 adding alternative numeric indicators to the discs.

U.S. Pat. No. 5,634,639 issued to Tokito et al. sets forth a BALL GAME APPARATUS WITH A PLURALITY OF DIFFERENT BALLS AND WINNING POCKET PORTIONS in which a game apparatus includes a spiral rail for automatically delivering balls together with a field portion on which the delivered balls are able to roll with a degree of freedom. Winning pocket portions and invalid pockets are formed in the field portion for receiving a plurality of balls therein. A CCD camera is provided for counting the number of balls received in the winning pocket portion.

U.S. Pat. No. 3,845,958 issued to Weinertsen sets forth a LETTERS AND NUMBERS GAME for teaching children basic letters and number concepts. A plurality of character discs having distinct characters, letters or numbers formed thereon cooperate with complementary characters or the like formed on character trays within the toy. In addition, a device is provided which includes a housing having disc storage and dispensing stations therein. A ramp at the storage station is provided for supporting a plurality of individual character discs in an aligned stack while a pusher is provided to urge the discs toward the dispensing station. A dispensing plate is mounted for reciprocal movement at the dispensing station for removing individual discs and discharging them from the toys housing.

U.S. Pat. No. 936,057 issued to Taylor; U.S. Pat. No. 1,655,296 issued to Tapio; U.S. Pat. No. 2,731,268 issued to Raizen; and U.S. Pat. No. 2,721,083 issued to Allain set forth examples of early token and ball type chance games.

U.S. Pat. No. 2,893,735 issued to Tranter Jr.; U.S. Pat. No. 3,048,402 issued to Schaper; and U.S. Pat. No. 3,437,338 issued to Glass et al. set forth further early examples of random chance games using objects such as balls or tokens.

U.S. Pat. No. 5,118,114 issued to Tucci set forth a METHOD AND APPARATUS FOR PLAYING A POKER TYPE GAME which includes a betting table, a random selection device for selecting the dealer's spot or hand or playing cards. The betting table is arranged in a system facilitating the betting rules of a new game known as Action Poker which automatically permits a player to know their status from an odd or no-pay stand point after each card.

U.S. Pat. 2,792,227 issued to Auerbach; U.S. Pat. No. 2,003,979 issued to Skoric; and U.S. Pat. No. 2,705,900 set forth examples of early random selection apparatus of the type used in various games.

In a related art, U.S. Pat. No. 2,759,632 issued to Ussery et al. and U.S. Pat. No. 2,979,230 issued to Calverly set forth examples of tablet or pill dispensing apparatus.

While the foregoing prior art devices have to some extent improved the art and have in some instances enjoyed commercial success, there remains nonetheless a continuing need in the art for evermore improved, interesting and amusing game apparatus for young children.

SUMMARY OF THE INVENTION

Accordingly, it is a general object of the present invention to provide an improved game apparatus. It is a more particular object of the present invention to provide an improved game apparatus which is particularly suited to the needs of very young children. It is a still more particular object of the present invention to provide an improved game apparatus suited to the needs of young children which aides such young children in the development of a number of basic skills such as hand/eye coordination, color discrimination, shape and geometric relationships, numeric quantities and sequence of activities.

In accordance with the present invention there is provided a game apparatus comprising: a figure having a head defining a slot, a torso, a moveable arm and a torso support; a plurality of tokens received within the head through the slot; a rotatable plate within the head; gear drive means, coupled between the moveable arm and the rotating plate, for rotating the plate in response movement of the moveable arm; and a token gate supported within the figure operative in response to movement of the gear drive means to allow a token to move from the figure, the moveable arm being moved by a game player to rotate the rotating plate and agitating the plurality of tokens and the gear drive means and the token gate cooperating to dispense a token from the figure.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
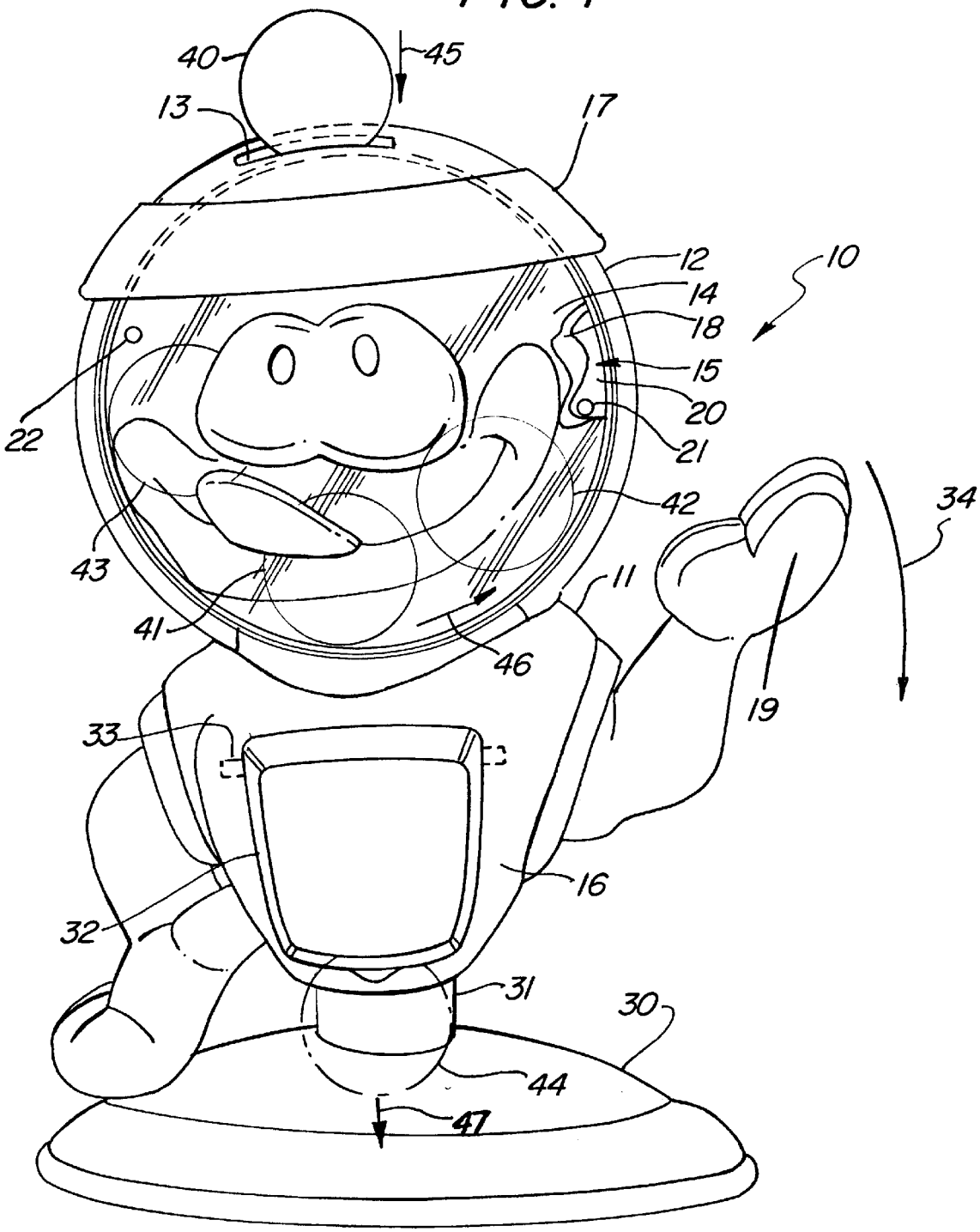
FIG. 1 sets forth a front view of a token dispensing game apparatus constructed in accordance with the present invention.

FIG. 1 sets forth a partial sectioned front view of a game apparatus constructed in accordance with the present invention and generally referenced by numeral 10. Game apparatus 10 is fabricated to generally resemble a fanciful cartoon figure however, it will be understood by those skilled in the art that game apparatus 10 may be fabricated to present other appearances without departing from the spirit and scope of the present invention. Game apparatus 10 includes a body 11 preferably formed of a molded plastic material or the like having a head 12 supporting a clear face plate 14 having a fanciful partial face image thereon. Head 12 further supports a cap 17 defining a slot 13 in the upper portion thereof. Head 12 further includes a front plate 18 and a rotating plate 20. As is better seen in FIG. 2, front plate 18 is positioned in front of a back plate 50 to define an interior cavity 15 therebetween. Rotating plate 20 includes a pair of cylindrical pegs 21 and 22 and is rotatably supported within interior cavity 15. Body 11 further includes a torso portion 16 supported by a generally cylindrical stand 31 upon a support base 30. Torso 16 further supports a door 32 having an upper hinge 33 allowing door 32 to pivot outwardly from the bottom in the manner illustrated in FIG. 2. Body 11 further includes an arm 19 which is pivotally supported in the manner set forth below in FIG. 3. Suffice it to note here, that arm 19 is capable of being pivoted downwardly in the direction indicated by arrow 34.

In further accordance with the present invention, a plurality of generally disc-shaped tokens 40, 41, 42, 43 and 44 are utilized in playing the intended game of the present invention game apparatus. Accordingly, tokens such as token 40 are inserted through slot 13 into interior cavity 15. Within interior cavity 15, a plurality of tokens such as tokens 41, 42 and 43 are captivated and visible behind clear face plate 14 and clear front plate 18. While front plate 18 and face plate 14 are preferably fabricated of a transparent clear plastic material, it will be apparent to those skilled in the art that tinted or colored transparent materials may be used without departing from the spirit and scope of the present invention.

In operation, the child user inserts a plurality of tokens through slot 13 to be received within interior cavity 15. The tokens deposited through slot 13 are visible through clear face plate 14 and clear front plate 18. The child then pivots arm 19 downwardly in the direction indicated by arrow 34. By means set: forth below in greater detail, the downward movement of arm 19 imparts a rotation to rotating plate 20 in the direction indicated by arrow 46. The rotation of rotating plate 20 causes pegs 21 and 22 to impact and move tokens within interior cavity 15 such as tokens 41, 42 and 43. As rotating plate 20 continues to spin, the tokens within interior cavity 15 are rapidly moved and irrationally tumbled. By means set forth below in greater detail, the mechanism operative within torso 16 also operates to allow a single one of the tokens rotating and spinning within interior cavity 15 to be dispensed downwardly through torso 16 and outwardly passed door 32. The mechanism which provides this action is set forth below and described in greater detail. However, suffice it to note here that a token gate 60 (seen in FIG. 2) together with an escapement 81 (seen in FIG. 3) cooperate under the impetus of arm 19 movement to randomly permit a single token to be discharged downwardly through torso 16 and door 32. The token discharged is randomly selected which imparts an element of chance and excitement to the intended game.

While a variety of game play scenarios may be utilized in combination with game apparatus 10, one popular game scenario involves using tokens of different colors which player attempt to accumulate by taking their respective turns in moving arm 19. In such a game scenario for example, players would be called upon to be the first to accumulate a predetermined combination of colors such as all colors being different or all colors being the same. The random chance by which tokens drop through slot 13 eventually are discharged through door 32 permits the young child to enjoy a substantial excitement in the game play.

Figure 2:
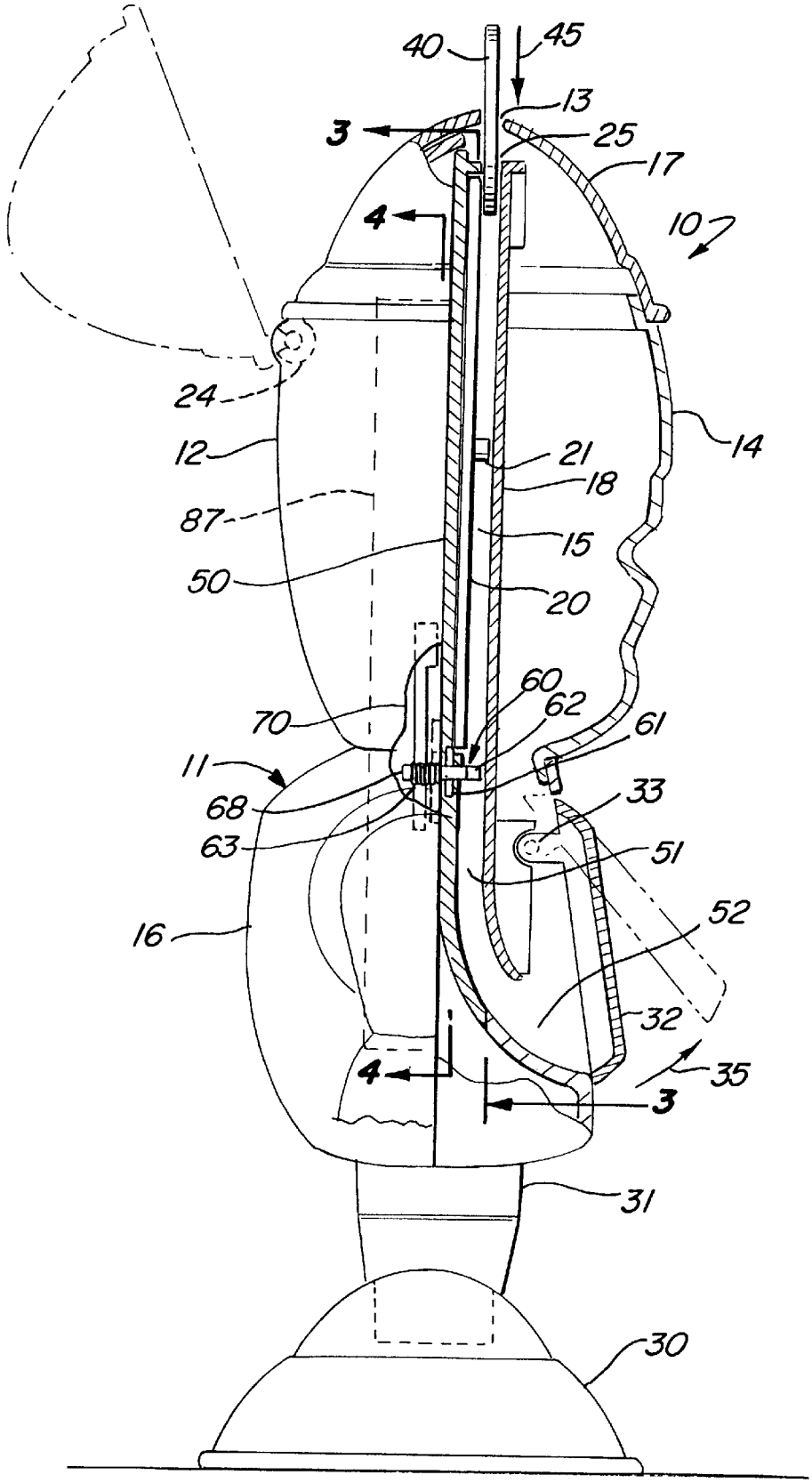
FIG. 2 sets forth a partial section side elevation view of the present invention token dispensing game apparatus.

FIG. 2 sets forth a partial section view of the present invention game play apparatus. As described above, game play apparatus 10 includes a body 11 having a head 12 which in turn supports a cap 17 defining a slot 13 therein. Cap 17 is pivotally supported upon head 12 by a hinge 24. Head 12 further includes a clear or transparent face plate 14 together with a clear or transparent front plate 18 and a back plate 50. Back plate 50 may be fabricated of opaque or clear material as the user chooses. A rotating plate 20 having a peg 21 extending therefrom is rotatably supported upon back plate 50 in the manner shown in FIG. 3. Rotating plate 20 is positioned within interior cavity 15 formed between front plate 18 and back plate 50. A slot 25 is formed between front plate 18 and back plate 50 in general alignment with slot 13 of cap 17 to facilitate the gravity driven insertion of a token such as token 40 being dropped in the direction indicated by arrow 45.

The lower end portions of back plate 50 and front plate 18 are generally forwardly curved to define a passage 51 therebetween. The end of passage 51 defines an aperture 52 which is covered by a pivotally secured door 32. Door 32 is hinged at its upper portion at a conventional hinge 33. Torso 16 is supported upon stand 31 which in turn is supported by base 30.

In the preferred fabrication of the present invention, a token gate generally referenced by numeral 60 is positioned above passage 51 within interior cavity 15. Token gate 60 includes a pivoting support pin 61, an outer end 62 and a rearward end 68. Pivot pin 61 supports token gate 60 in a pivoting support which allows token gate 60 to move between the closed position shown in FIG. 2 and the open position shown in FIG. 3. A spring 63 is coupled to token gate 60 urging token gate 60 toward the position of closure shown in FIG. 2. In the closed position shown in FIG. 2, token gate 60 prevents tokens within interior cavity 15 from entering passage 51. Conversely, in its open position, token gate 60 allows a token within interior cavity 15 to enter passage 51 for ultimate discharge through aperture 52 and door 32. By means set forth below in FIGS. 4 and 5, a gear segment 70 is moveable against end 68 of token gate 60 as arm 19 (seen in FIG. 4) is pivoted downwardly. As is also described below in greater detail, the movement of gear segment 70 in response to movement of arm 19 causes token gate 60 to be pivoted about pin 61 against the force of spring 63 to its open position thereby allowing one token to fall downwardly from interior cavity 15 to passage 51.

Figure 3:
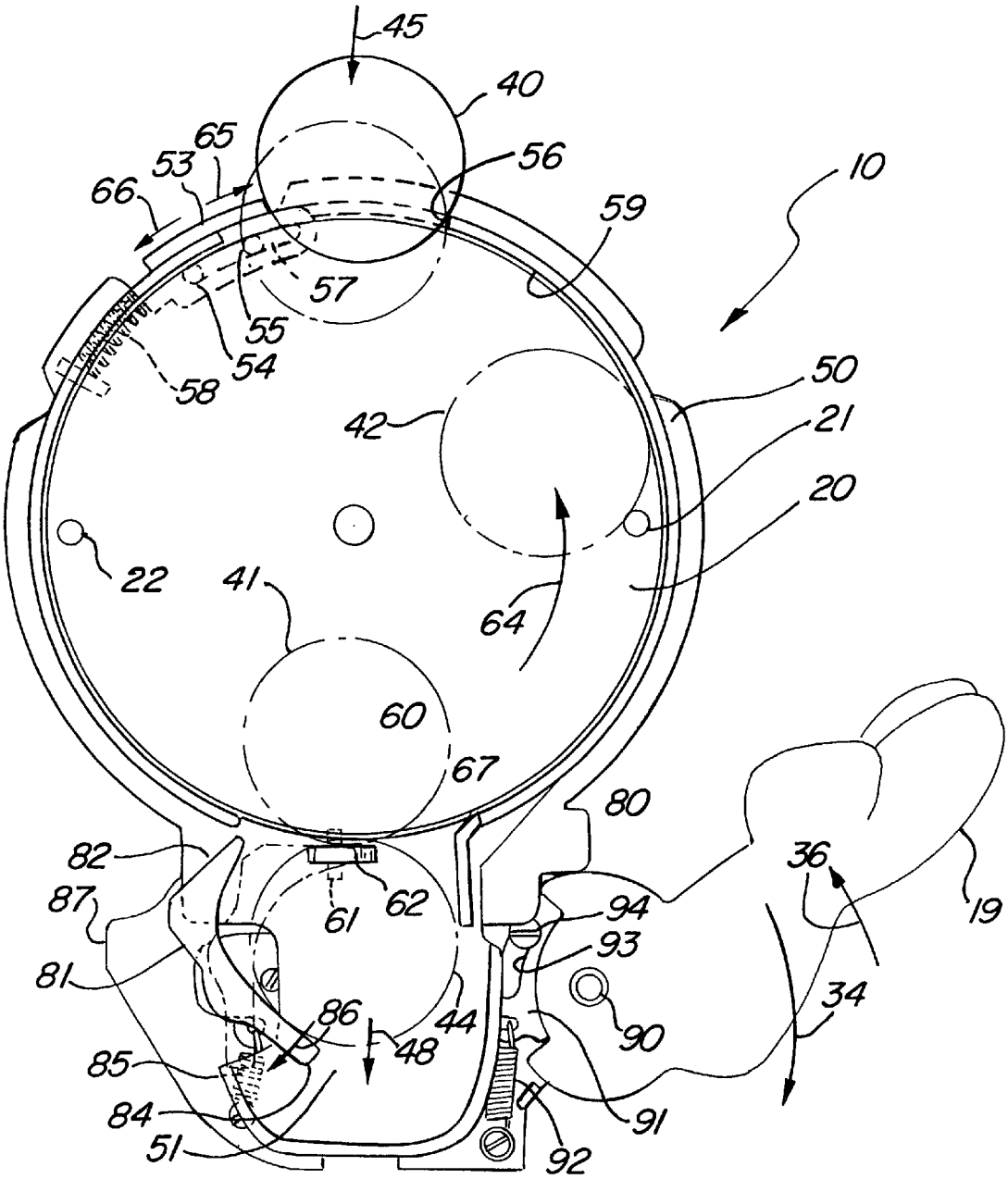
FIG. 3 sets forth a partial section view of the present invention token dispensing game taken along section lines 3—3 in FIG. 2.

FIG. 3 sets forth a partial section view of game apparatus 10 taken along section lines 3—3 in FIG. 2. Game apparatus 10 includes a back plate 50 supporting a rotating plate 20. Back plate 50 further defines a generally cylindrical wall 59 encircling the outer edge of rotating plate 20. Wall 59 defines a slot 56 in the upper portion thereof. Slot 56 is substantially greater than the diameter of a token 45. This allows token 45 to be dropped downwardly in the direction indicated by arrow 45 through slot 56 and into interior cavity 15 (seen in FIG. 2). Game apparatus 10 further includes a slidably supported shutter 53 which defines a slot 57 therein. Slot 57 receives a pair of fasteners 54. The cooperation of slot 57 and fasteners 54 allows shutter 53 to be moveable in the directions indicated by arrows 65 and 66 to provide closure and opening respectively of slot 56. A spring 58 is supported upon back plate 50 and is coupled to shutter 53 urging shutter 53 toward the direction indicated by arrow 65. Thus, in the absence of a token such as token such as token 40 being inserted into slot 56, shutter 53 remains in its extended position partially blocking slot 56 and preventing the exit of any tokens within interior cavity 15 (seen in FIG. 2).

A gear plate 87 is joined to the lower edge of back plate 50 and supports a guide 80. Gear plate 87 further supports a pivot. 90 upon which arm 19 is pivotally supported for movement in the directions indicated by arrows 34 and 36. Arm 19 includes a gear segment 91 moveable in conjunction with arm 19 and defining slot. 93. A fastener 94 is received within slot 93 and secured to gear plate 87. A spring 92 is coupled between gear plate 87 and gear segment 91 to urge arm 19 upwardly in the direction indicated by arrow 36. The cooperation of fastener 94 and the upper end of slot 93 provides an upward travel limit to maintain the raised position of arm 19 at the position shown in FIG. 3.

Game apparatus 10 further includes a token gate 60 supported within a slot 67 formed in back plate 50 by a pivot pin 61. As mentioned above, token gate 60 operates to prevent tokens within interior cavity 15 (seen in FIG. 1) from moving downwardly from interior cavity 15. As is also mentioned above, token gate 60 is pivoted from the closed position shown in FIG. 2 to the open position shown in FIG. 3 by the action of a gear segment 70 (seen in FIG. 2).

Game apparatus 10 further includes an escapement mechanism 81 pivotally supported upon back plate 50 by a pivot 83. Escapement 81 includes a spring 85, a tooth 82 and a lower end 84. Spring 85 urges escapement 81 toward the position shown in solid line representation in FIG. 3. By means set forth below in FIGS. 4 and 5, escapement 81 is pivoted against the force of spring 85 in the direction indicated by arrow 86 as arm 19 is pulled downwardly in the direction indicated by arrow 34. By means also set forth below in greater detail, the downward movement of arm 19 causes rotating plate 20 to be spun in the direction indicated by arrow 64.

As arm 19 is pivoted downwardly in the direction indicated by arrow 34, gear segment 70 (seen in FIG. 4) pivots token gate 60 to its open position. This in turn allows a single token such as token 41 to move downwardly passed guide 80 and escapement 81 to the position occupied by token 44 in FIG. 3. By means also set forth below in greater detail in FIGS. 4 and 5, the completion of a downward stroke of arm 19 pivots escapement 81 to the dash line position shown. This pivotal movement of escapement 81 prevents further token passage from interior cavity 15 (seen in FIG. 2). Thus, in this manner, a single token randomly aligned with token gate 60 is passed beyond token gate 60 downwardly into passage 51 (seen in FIG. 2) to the position shown by dashed line token 44.

As arm 19 continues to move downwardly, and as escapement 81 continues to pivot toward the dashed line position shown, end portion 84 of escapement 81 pivots in the directions indicated by arrow 86. At some point, the pivotal movement of end 84 is sufficient to release token 44 allowing it to fall downwardly in the direction indicated by arrow 48. With temporary return to FIG. 2, it will be apparent that the downward drop of a token such as token 44 through passage 51 and aperture 52 will pivot door 32 in the direction indicated by arrow 35 allowing the token to be ejected from the game apparatus.

In this manner, the selection of a given token for release from head 12 of game apparatus 10 and discharge through door 32 is entirely a matter of random chance. This improves the excitement of the games played with the apparatus and is compatible with very young children where a minimum skill level is available.

Once arm 19 is released, spring 92 pivots arm 19 upwardly in the direction indicated by arrow 36. By means set forth below in greater detail, the upward movement of arm 19 moves gear segment 70 (seen in FIG. 2) away from token gate 60 and allows token gate 60 to again assume its closed position. Concurrently, the upward pivotal movement of arm 19 returns escapement 81 to the solid line position shown under the force of spring 85.

Figure 5:
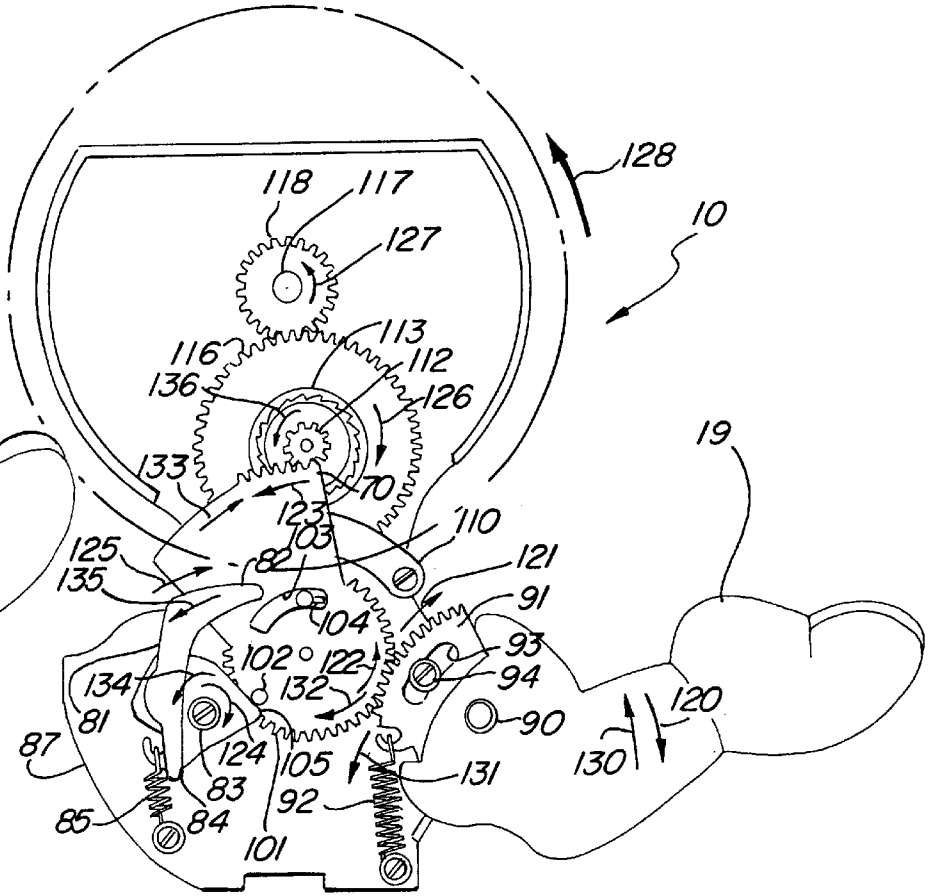
FIG. 5 sets forth a partial section view of the present invention game apparatus corresponding to the section view of FIG. 4 showing the completion of an operative cycle of the game mechanism.
Figure 4:
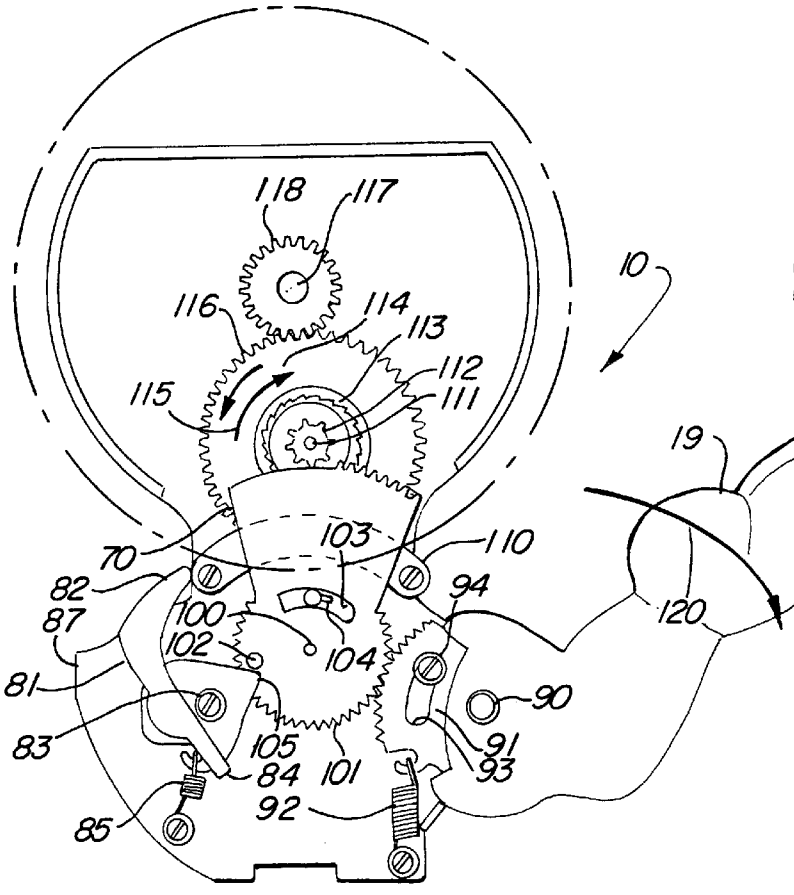
FIG. 4 sets forth a partial section view of the present invention token dispensing game apparatus taken along section lines 4—4 in FIG. 2.

FIGS. 4 and 5 set forth identical section views of game apparatus 10 both of which are taken along section lines 4—4 in FIG. 2. However, by way of overview, it will be noted that FIG. 4 shows a section view of game apparatus 10 having arm 19 in its raised position while FIG. 5 sets forth the same section view having the game apparatus in the configuration and position resulting from downward pivotal movement of arm 19.

More specifically, game apparatus 10 includes a gear plate 87 supporting a pivot 90 which in turn pivotally supports an arm 19. Arm 19 is joined to a gear segment 91 having a slot 93 formed therein. A fastener 94 is received within slot 93 and provides an upward travel limit stop for arm 19. A spring 92 is coupled between gear plate 87 and gear segment 91 to urge arm 19 toward its fully raised position.

Gear 101 is rotatably supported upon a pivot 100 and defines a slot 103 therein. A limit stop 104 extends into slot 103 from gear plate 87 and limits the travel of gear 101. Gear 101 further supports a gear segment 70 all of which is rotatable about a pin 100. An arcuate guide 110 is positioned against gear segment 70 to provide a bearing surface for movement thereof.

An escapement 81 includes a pivot 83 and a cam 105. Escapement 81 further includes a tooth 82 and a lower end 84. A spring 85 urges escapement 81 and cam 105 toward a counter-clockwise rotation about pivot 83. A post 102 is supported upon gear 101 and interacts with cam 105 to move escapement 81.

A shaft 117 rotatably supports rotating plate 20 (seen in FIG. 3) and a gear 118. Gear 118 is joined to and rotatable with rotating plate 20 (seen in FIG. 3). A shaft 111 supports a gear 112 which in turn is coupled to a ratchet mechanism 113. Ratchet mechanism 113 includes an inner portion joined to gear 112 and an outer portion joined to gear 116. Gear 116 engages gear 118.

In the position shown in FIG. 4, arm 19 is its relaxed or raised position and is maintained in the raised position by the force of spring 92. Also in the position shown in FIG. 4, gear segment 70 is pivoted away from token gate 60 (seen in FIGS. 2 and 3) allowing token gate 60 to maintain its closed position. The operative cycle of the present invention game apparatus is initiated as the user pushes arm 19 downwardly about pivot 90 in the direction indicated by arrow 120. The resulting movement of arm 19 and gear segment 91 produces the sequences of movements shown in FIG. 5.

By way of overview, FIG. 5 shows the resulting positions of components within game apparatus 10 as arm 19 is pivoted downwardly about pivot 90 to the full downward travel limit.

More specifically, game apparatus 10 includes a gear plate 87 supporting a pivot 90 which in turn pivotally supports an arm 19. Arm 19 is joined to a gear segment 91 having a slot 93 formed therein. A fastener 94 is received within slot 93 and provides an upward travel limit stop for arm 19. A spring 92 is coupled between gear plate 87 and gear segment 91 to urge arm 19 toward its fully raised position.

Gear 101 is rotatably supported upon a pivot 100 and defines a slot 103 therein. A limit stop 104 extends into slot 103 from gear plate 87 and limits the travel of gear 101. Gear 101 further supports a gear segment 70 all of which is rotatable about a pin 100. An arcuate guide 110 is positioned against gear segment 70 to provide a bearing surface for movement thereof.

An escapement 81 includes a pivot 83 and a cam 105. Escapement 81 further includes a tooth 82 and a lower end 84. A spring 85 urges escapement 81 and cam 105 toward a counter-clockwise rotation about pivot 83. A post 102 is supported upon gear 101 and interacts with cam 105 to move escapement 81.

A shaft 117 rotatably supports rotating plate 20 (seen in FIG. 3) and a gear 118. Gear 118 is joined to and rotatable with rotating plate 20 (seen in FIG. 3). A shaft 111 supports a gear 112 which in turn is coupled to a ratchet mechanism 113. Ratchet mechanism 113 includes an inner portion joined to gear 112 and an outer portion joined to gear 116. Gear 116 engages gear 118.

As arm 19 is pivoted downwardly in the direction indicated by arrow 120 overcoming the force of spring 92, gear segment 91 is pivoted upwardly in the direction indicated by arrow 121. The engagement of gear segment 91 and gear 101 rotates gear 101 about pin 100 in the direction indicated by arrow 122. The extent of rotation of gear 101 is limited by the action of limit stop 104 against the end of slot 103.

As gear 101 pivots in the direction indicated by arrow 122, gear segment 70 pivots in the direction indicated by arrow 123 engaging gear 112. Concurrently, the pivoting of gear 101 in the direction of arrow 122 forces post 102 against cam 105. As post 102 moves against cam 105, escapement 81 is pivoted in the direction indicated by arrow 124. This pivotal movement of escapement 81 moves tooth 82 inwardly in the direction indicated by arrow 125.

It will be recalled that gear segment 70 operates as it is pivoted in the direction indicated by arrow 123 to move token gate 60 (seen in FIGS. 2 and 3) from its normally closed position to its open position. Thus, a period of time exists during which token gate 60 (seen in FIGS. 2 and 3) is moved to its open position and escapement 81 is in the process of being pivoted in the direction indicated by arrow 124 by post 102 against cam 105. During this time interval, tooth 82 has not yet moved into the blocking position shown in FIG. 5 and accordingly upon the opening of token gate 60 (seen in FIGS. 2 and 3) a single token descends downwardly passed token gate 60 in the position shown by token 44 in FIG. 3. Thereafter, as gear segment 70 continues to move in the direction indicated by arrow 123 and tooth 182 of escapement 81 moves in the direction indicated by arrow 125 further dropping of any other tokens within the game unit is prevented by the inward movement of tooth 82. In this manner, the present invention game apparatus operates to dispense a single token during a downward stroke of arm 19.

As gear segment 70 moves in the direction indicated by arrow 123, engaging gear 112 and rotating it in the direction indicated by arrow 126, ratchet 113 engages gear 116 causing it to rotate gear 118 in the direction indicated by arrow 127. As mentioned above, the rotation of gear 127 produces a corresponding rotation of rotating plate 20 (seen in FIG. 3). As rotating plate 20 spins in the manner shown in FIG. 1, the plurality of tokens within the game unit are agitated and spun about for an amusing effect.

Once the token has been dispensed and the spinning of rotating plate 20 (seen in FIG. 3) has slowed or terminated, the user may release arm 19 allowing spring 92 to pivot arm 19 upwardly about pivot 90 in the direction indicated by arrow 130. This movement of arm 19 pivots gear segment 91 in the direction indicated by arrow 131 which in turn rotates gear 101 about pin 100 in the direction indicated by arrow 132. The pivoting movement of gear 101 in the direction of arrow 132 pivots gear segment 70 in the direction indicated by arrow 133. This in turn rotates gear 112 in the direction indicated by arrow 136. In this reverse direction of rotation, the engagement between gear 112 and gear 116 provided by ratchet 113 is released and no corresponding rotation of gear 116 or gear 118 taken place. Accordingly, rotating plate 20 (seen in FIG. 3) is not rotated in a reverse direction as arm 19 is raised.

The pivotal movement of gear segment 70 in the direction of arrow 133 does however return token gate 60 (seen in FIG. 3) to its closed position. Thus further token dispensing is prevented. As gear 101 rotates in the direction indicated by arrow 132, Post 102 moves away from cam 105 allowing spring 85 to pivot escapement 81 about pivot 83 in the direction indicated by arrow 134. This pivotal movement of escapement 81 moves tooth 82 outwardly in the direction indicated by arrow 135. At this point, the mechanism has returned to the relaxed position shown in FIG. 4 in preparation for another cycle of operation.

This token dispensing operation is repeated by successive players and is maintained so long as the supply of tokens within the game unit replenished.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A game apparatus comprising:

a figure having a head defining a slot, a torso, a moveable arm and a torso support;

a plurality of tokens received within said head through said slot;

a rotatable plate within said head;

gear drive means, coupled between said moveable arm and said rotating plate, for rotating said plate in response movement of said moveable arm; and a token gate supported within said figure operative in response to movement of said gear drive means to allow a token to move from said figure, said moveable arm being moved by a game player to rotate said rotating plate and agitating said plurality of tokens and said gear drive means and said token gate cooperating to dispense a token from said figure, and said gear drive means including a one-way ratchet drive for rotating said rotating plate in a first direction when said arm is moved from said raised position to said lowered position and releasing said rotating plate when said arm is raised from said lowered position to said raised position.

2. The game apparatus set forth in claim 1 wherein said head includes a transparent front plate and a back plate defining an interior cavity therebetween and wherein said rotating plate is supported within said interior cavity.

3. The game apparatus set forth in claim 2 wherein said moveable arm is pivotable between a raised position and a lowered position and wherein said moveable arm includes a spring urging said arm toward said raised position.

4. The game apparatus set forth in claim 3 wherein said torso includes a passage in communication with said interior cavity having a discharge aperture and wherein said torso includes a door covering said discharge aperture.

5. The game apparatus set forth in claim 4 wherein said door is pivotably supported on said torso by a hinge above said discharge aperture.

* * * * *